United States Patent [19]

Takagi et al.

[11] Patent Number: 4,949,007

[45] Date of Patent: Aug. 14, 1990

[54] LOW PRESSURE DISCHARGE LAMP WITH FLAT-PLATE TERMINAL

[75] Inventors: Masami Takagi, Yokohama; Shinichi Tsunekawa, Fujisawa; Kenji Ohkubo, Kawasaki, all of Japan

[73] Assignee: Kabushiki Kaisha Toshiba, Kawasaki, Japan

[21] Appl. No.: 358,534

[22] Filed: May 26, 1989

Related U.S. Application Data

[63] Continuation of Ser. No. 163,101, Mar. 2, 1988, abandoned.

[30] Foreign Application Priority Data

Mar. 5, 1987 [JP] Japan ..... 62-32508[U]

[51] Int. Cl.[5] ..... H01J 61/36

[52] U.S. Cl. ..... 313/318; 313/493; 439/226; 439/612

[58] Field of Search ..... 313/318, 493, 631, 323, 313/324, 634, 3; 439/226, 227, 232, 233, 612, 616, 617

[56] References Cited

U.S. PATENT DOCUMENTS 3,413,511 11/1968 Plagge ..... 313/318

FOREIGN PATENT DOCUMENTS 38-443 1/1938 Japan .
60-130440 8/1985 Japan .
62-12255 1/1987 Japan .

*Primary Examiner*—Kenneth Wieder
*Attorney, Agent, or Firm*—Cushman, Darby & Cushman

[57] ABSTRACT

A low pressure gas discharge lamp includes a bulb with a pair of closed ends, and a pair of bases attached to the ends of the bulb, respectively. Each base has a cylindrical base body into which the end of bulb is inserted, and a pair of receiving terminals electrically connected to an electrode in the bulb and protruding from the base body in a direction perpendicular to the axis of the bulb. Each terminal has a pair of mutually parallel flat faces and is secured to the base body such that these flat faces are located on planes perpendicular to the axis of the bulb, and a part of at least one flat face is in contact with a bottom wall of the base body.

14 Claims, 4 Drawing Sheets

LOW PRESSURE DISCHARGE LAMP WITH FLAT-PLATE TERMINAL

This is a continuation of Application No. 07/163,101, filed Mar. 2, 1988, which was abandoned upon the filling hereof.

Background of the Invention

1. Field of the Invention

This invention relates to low pressure gas discharge lamps, including fluorescent lamps, cold cathode discharge lamps and glow lamps.

2. Description of the Related Art

Fluorescent lamps, cold cathode discharge lamps and glow lamps of straight tubular type are used as the light sources for various types of OA (office automation) equipment as well as for general lighting purposes and as the backlight light source for liquid crystal display units. Recently, there have been demands for miniaturization or increased effective luminescent length of these light sources. For the lamps used as the light source for OA equipment, due to limitations in space available for accommodation of lamp, it is desired to reduce the size of the lamp or increase the effective luminescent length when the length of the lamp is not changed.

Conventionally, in low pressure gas discharge lamps of this type, that is, straight fluorescent lamps for example, the bi-pin type bases, which each have a couple of terminal pins extending in the axial direction of the bulb, are used as the bases attached to the ends of the bulb. Since the bases each have a couple of terminal pins protruding in the axial direction of the bulb, the entire length including the terminal pins is long. In addition, lamp sockets need to be provided for the axial ends of the lamp in a manner that the lamp sockets are placed against the bases. As a result, the whole lighting equipment including the lamp sockets has to be large.

Japanese Utility Model Publication No. 38-443 discloses a lamp using bases each having flat-plate receiving terminals such as are used for attachment plugs. This base has substantially cylindrical base body whose one end is closed, and the terminals are secured to the base body in a manner that they extend in a direction perpendicular to the axis of the lamp. Each end portion of the bulb is inserted in the base body from the open side thereof.

With a lamp constructed as described above, the terminals do not protrude in the axial direction of the lamp from the ends thereof, and therefore, the entire length of a lamp can be shortened. Moreover, the lamp sockets into which the terminals are inserted can be installed on a lateral side of the end portion of the lamp. Therefore, there is no need to provide a large space in the axial direction of the lamp and the whole lighting equipment can be reduced in size.

The demands for further reductions in size and required space for installation of lamps have been mounting in recent years. However, the lamp disclosed in the above-mentioned Japanese Utility Model Publication cannot meet these demands. The reason is as follows.

To shorten the axial length of a lamp, the end parts of the bulb need to be inserted deep into the base bodies so that the end surfaces of the bulb come as close to the bottoms of the base bodies as possible. In the above-mentioned Japanese Utility Model Publication, however, a couple of terminals are mounted to the base bodies so that the flat faces of the terminals face each other and are located in planes which are in parallel with the axis of the bulb. Therefore, it is necessary to provide a space corresponding at least to the width of the terminal between the end surfaces of the bulb and the bottoms of the base bodies. As a result, the base bodies protrude by the amount of the terminal width in the axial direction of the bulb from the ends of the bulb.

Meanwhile, a lamp having a couple of flat-plate terminals is disclosed in Japanese Utility Model Publication No. 60-130440. The terminals are mounted in a manner that their flat faces are located in planes existing at right angles with the axis of the lamp and are arranged in the axial direction of the bulb with an insulation member applied between them.

Even in the lamp so constructed, since the terminals and the insulation member are arranged in the axial direction, the base body protrudes from the end of the bulb at least by the amount corresponding to the sum of their thicknesses. These terminals, being secured to the the peripheral wall of the base body, are low in mechanical strength against external forces which act in the axial direction of the bulb. Hence, there is a possibility that the terminals break when they are connected to the sockets.

Summary of the Invention

The present invention has been made in consideration of the above situation and has as its object to provide a low pressure gas discharge lamp which permits further reduction in lamp size, can have an increased effective luminescent length when the lamp length is the same as before and has sufficient mechanical strength.

In order to achieve the above object, according to this invention, a pair of bases attached to the ends of a bulb each have a substantially cylindrical base body with a bottom wall, in which one end portion of the bulb is inserted, and a flat-plate like terminal secured in the base body and electrically connected to the electrode of the bulb. The terminal has a pair of mutually parallel flat faces and is secured to the base body in such a manner that these flat faces are located on planes perpendicular to the axis of the bulb and a part of at least one flat face is in contact with the bottom wall of the base body. The terminal protrudes from the base body in a direction perpendicular to the axis of the bulb.

Brief Description of the Drawings

FIGS. 1 through 6 show a fluorescent lamp according to an embodiment of this invention; in which FIG. 1 is a perspective view of the whole lamp, FIG. 2 is a sectional view taken along line II—II of FIG. 1, FIG. 3 is a sectional view taken along line III—III of FIG. 1, FIG. 5 is a front view of a base, and FIG. 6 is a perspective view showing the base of FIG. 5 and a socket;

Detailed Description of the Preferred Embodiments

Preferred embodiments of this invention will now be described with reference to the accompanying drawings.

Figure 1:
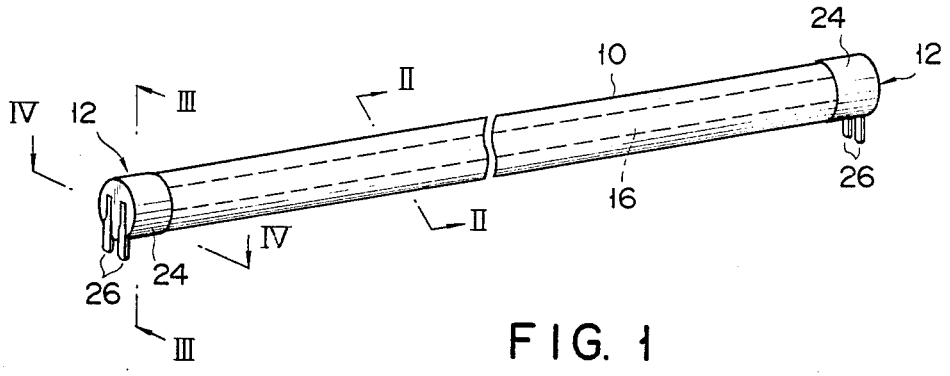
Figure 3:
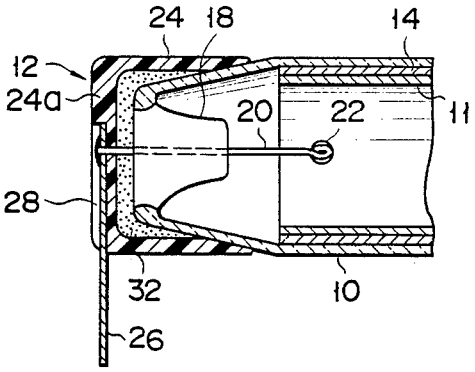
Figure 2:
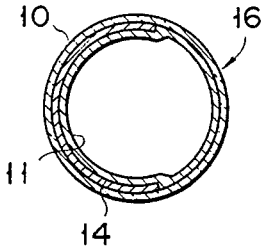

Referring first to FIG. 1, there is shown a straight fluorescent lamp according to an embodiment of this invention. This fluorescent lamp includes straight type bulb, that is, cylindrical bulb 10 and a pair of bases 12 attached to both ends of the bulb. As is shown in FIGS. 2 and 3, fluophor layer 11 is formed on the inner periphery of bulb 10, and reflective layer 14 is formed between the inner periphery of the bulb and fluophor layer 11 except for a specified area existing in the peripheral direction. The area where reflective layer 14 is not formed constitutes light-emitting section 16 which allows light to penetrate. This section extends in the axial direction of bulb 10 over the substantially full length of the bulb. Therefore, the fluorescent lamp is a so-called aperture type lamp which emits light only from a limited area in the peripheral direction of the bulb.

Figure 4A:
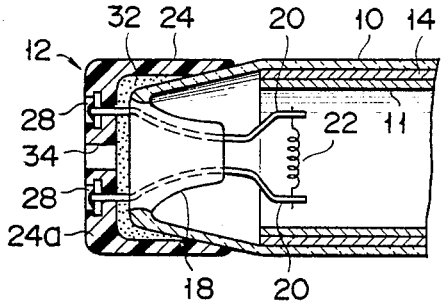
FIG. 4A is a sectional view taken along line IV—IV of FIG. 1.
Figure 4B:
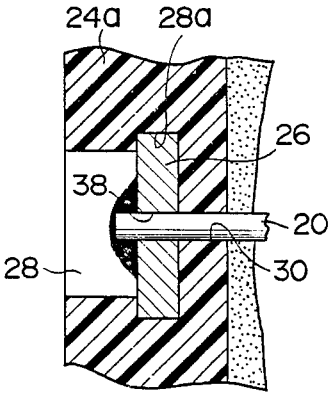
FIG. 4B is an enlarged sectional view showing a part of FIG. 4A.
Figure 5:
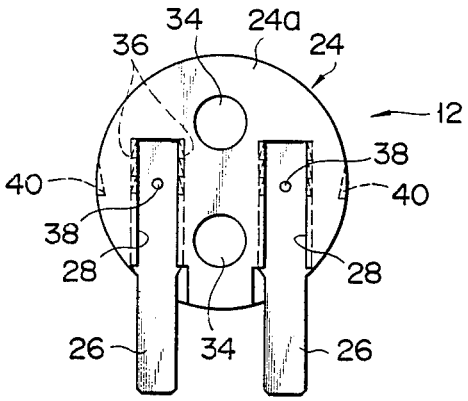

Referring to FIGS. 3 and 4A, both ends of bulb 10 are sealed with flare stem 18. A pair of lead wires 20 are passed airtightly through each piece of flare stem 18 and secured thereto. Filament electrode 22 is connected between the end portions of lead wires 20 which projects in bulb 10. Specified quantities of mercury and rare gas are contained in bulb 10.

As is shown in FIGS. 2 through 6, base 12 comprises cylindrical base body 24 whose one end is closed bottom wall **24*a* and a pair of receiving terminals 26 fixed to the base body. Base 12 is glued to the bulb, and the end portion of bulb 10 is inserted into base body 24. Base body 24 is coaxially positioned to bulb 10, and bottom wall 24*a* is at a right angle to the axis of the bulb. The portion of the end part of bulb 10 that is covered with base body 24 has a smaller outer diameter than the other portion of the bulb. Thus, the outer diameter of base body 24 is almost equal to that of the middle portion of bulb 10, and there is no stepped portion formed between the bulb and bases 12**.

Formed on the outer face of bottom wall **24*a* are a pair of connection grooves 28 mutually extending, parallel to each other. One end of each groove 28 is open at the periphery of the bottom wall. As is clear from FIG. 4B, the portion of groove 28 which lies at the bottom side of groove 28 constitutes wide-width portion 28*a*, which processes a width wider than the width of that portion of the groove which is open to the outer face of the bottom wall. Formed at the bottom of each groove 28 is through-hole 30 into which lead wire 20 is inserted. Through-hole 30 extends in the axial direction of bulb 10. In bottom wall 24*a* are formed a pair of working holes 34 through which adhesive 32 is supplied into base body 24. Working holes 34 extend in the axial direction of bulb 10**.

A pair of receiving terminals 26 are fitted into connection grooves 28 and fastened to base body 24. Receiving terminals 26 are narrow, substantially rectangular flat plates. The upper half of each receiving terminal 26 has the same width as wide-width portion **28*a* of connection groove 28 and is fitted into this widewidth portion. The lower halves of receiving terminals 26 protrude from base body 24 in a direction perpendicular to the axis of bulb 10. Therefore, each receiving terminal 26 is fastened on the bottom wall of base body 24, with one flat face and both lateral sides of the upper half of terminal 26 being in contact with the bottom wall. Thus, a pair of receiving terminals are arranged to be parallel to one another, and the flat faces of the terminals are also parallel to bottom wall 24*a* of base body 24, that is, positioned on a plane which is perpendicular to the axis of bulb 10. Receiving terminals 26 protrude in a specified direction relative to light-emitting section 16 of bulb 10**.

A plurality of stopper teeth 36 are formed on either side of the upper half of receiving terminal 26. These stopper teeth 36 prevent receiving terminals 26 from slipping out of connection grooves 28. Each terminal 26 has through hole 38 formed therein. Under the condition that the terminals are fitted in connection grooves 28, through holes 38 are aligned with throughholes 30 and are placed against the end parts of lead wires 20 which protrude from the end of bulb 10. Each end part of lead wires 20 is inserted into corresponding throughholes 30 and 38 and soldered to terminal 26. Thus, a pair of terminals 26 are electrically connected to filament electrode 22 through lead wires 20.

A couple of recesses 40 are formed at the peripheral wall of base body 24.

Base 12 thus constructed is fixed to each end part of bulb 10 by the following processes. First, the end part of bulb 10 is inserted deep into base body 24 from the open end thereof, that is, until the peripheral edge of base body 24 contacts the peripheral surface of bulb 10. Hence, base body 24 is coaxially fitted to bulb 10 over the end part of bulb 10. In the inserting process, each end portion of lead wires 20 projecting from the end of bulb 10, is inserted into the corresponding through holes 30 and 38 which are formed in bottom wall **24*a* and terminal 26, respectively. The extended ends of lead wires 20 are soldered to the corresponding terminals 26 from the outside of base body 24. Thus, base 12 is temporarily fixed to the end of bulb 10. Then, adhesive 32 is supplied between the end of bulb 10 and the inner surface of base body 24 from working holes 34. As a result, base 12 is firmly secured to bulb 10 by adhesive 32**.

Figure 6:
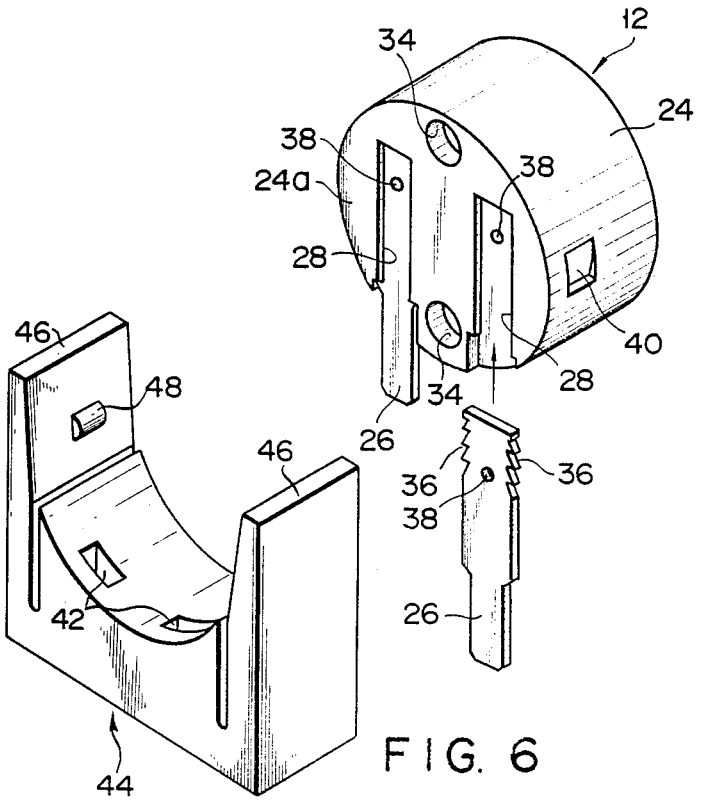

When a fluorescent lamp having the above construction is used, terminals 26 protruding from each base body 24, are fitted into connection holes 42 of a socket 44 shown in FIG. 6. Base body 24 is elastically clamped between a pair of holding walls 46 of the socket. Thus, the lamp is connected to a power supply. Meanwhile, a mechanical connection between the fluorescent lamp and the sockets can be effected by the connection of terminals 26 to the sockets. In addition, projections 48, formed on the inner surfaces of holding walls 46, are fitted in recesses 40 which is formed in base body 24. Thus, the fluorescent lamp can be mechanically supported by sockets 44.

A fluorescent lamp so constructed has the following advantages. A pair of receiving terminals 26 of each base 12 protrude from base body 24 in a direction perpendicular to the axis of bulb 10 and are arranged parallel to one another in such a manner that the flat faces of the terminals are positioned on a plane located at a right angle to the axis of the bulb. Therefore, the space required along the axis of bulb 10 for installing receiving terminals 26 need only be an amount which corresponds to the thickness of the terminals. Each receiving terminal 26 is installed with one-side of their flat face being in contact with bottom wall **24*a* of base body 24. Therefore, the end parts of bulb 10 can be deeply inserted into base body 24, that is, close to bottom wall 24*a*** and, as a result, the length of a fluorescent lamp can be reduced.

When the fluorescent lamp has the same length as a fluorescent lamp of the prior art, the length of the bulb itself, that is, the effective luminescent length can be increased.

Each receiving terminal 26 is secured to base body 24 with its flat face being in contact with bottom wall 24a of the base body. In the above embodiment of this invention, each terminal 26 is fitted into connection groove 28 formed in bottom wall 24a and secured with a part of one flat face, and both lateral sides of the terminal contact the bottom wall. Therefore, if terminals 26 are secured to base body 24 with sufficient mechanical strength, there is no possibility of the terminals becoming loose or breaking when they are subjected to external forces. Terminals 26 can be secured in base body 24 by simply inserting the terminals into connection grooves 28 of bottom wall 24a, thereby making the mounting of terminals 26 very easy.

Through holes 30 and 38 are formed respectively in bottom wall 24a of base body 24 and in terminal 26, through which the extended end part of each lead wire 20 is inserted, and mutually extend coaxially in the axial direction of bulb 10. Further, through holes 30 and 38 are located against the extended end part of lead wire 20. Therefore, the extended end part of each lead wire 20 can be easily inserted into through-holes 30 and 38, and can be soldered to receiving terminal 26 on the outside of base body 24. Hence, lead wires 20 and receiving terminals 26 can be easily connected. Base 12 is attached to bulb 10 by soldering lead wires 20 to terminals 26 and by applying adhesive 32 between base body 24 and the end of bulb 10, with the resulting base being firmly secured to the bulb.

Receiving terminals 26 protrude in a direction which intersects the axis of bulb 10. Therefore, when the terminals are connected to the socket, the orientation of the bulb is not changed. Therefore, when a fluorescent lamp is installed, the direction in which the light radiates can be easily aligned with a desired direction, by presetting the protruding direction of terminals 26 in relation to light-emitting section 16 of bulb 10.

This invention is not limited to the above described embodiment but may be embodied in various forms within the scope of the invention.

Figure 7:
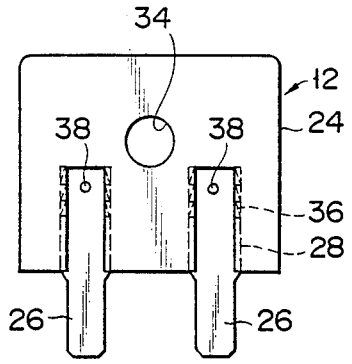
FIGS. 7 through 9 are front views of modifications of the base.
Figure 8:
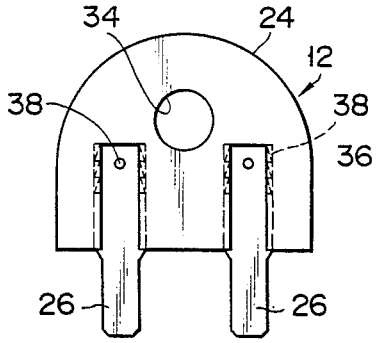

For example, the shape of base body 24 is not limited to a cylindrical form but may be of a rectangular form or a semi-circular cylindrical form as is shown in FIGS. 7 and 8.

This invention is not limited to fluorescent lamps and can be applied to cold-cathode discharge lamps as well as glow lamps. Among cold-cathode discharge lamps and glow lamps, a well-known type is that wherein only one lead wire is connected to an electrode. For lamps of this type, it is only necessary to install a piece of receiving terminal 26 for each base body 24, as is shown in FIG. 9.

Figure 9:
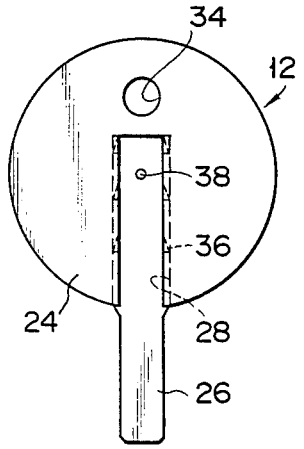

In FIGS. 7 through 9, the same numerals used in the above embodiment designate the same members in the other embodiments and, hence, their detailed description is omitted here.

Figure 10:
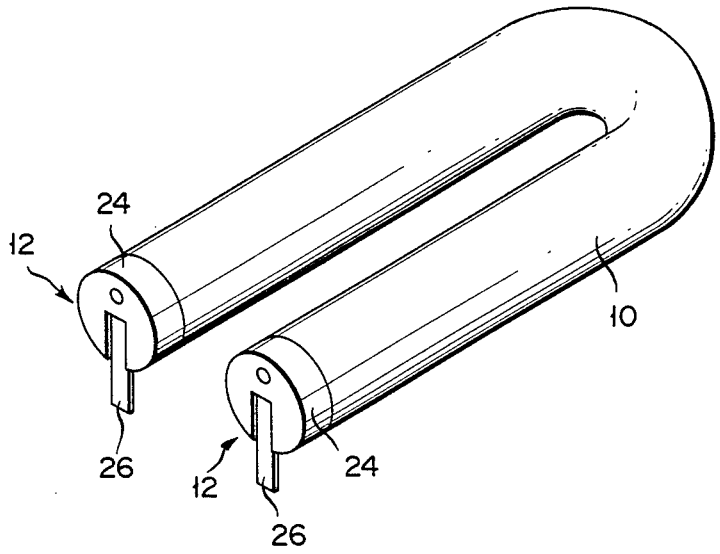
FIG. 10 is a perspective view showing a fluorescent lamp according to another embodiment of this invention.

A bulb used in carrying out this invention is not limited to an aperture type bulb which has a light-emitting section as described above, but may be an ordinary type bulb. Further, as is shown in FIG. 10, a bulb is not limited to a straight type but may be a U-shaped type.

The stems in the bulb are not limited to flare type stems but may be button type stems. A button type stem is shaped like a flat plate and does not protrude much into the inside of the bulb from the end thereof. Thus, it is possible to shorten the distance between the end of the bulb and the electrode. Therefore, if a bulb with button stems has the same length as that of a bulb with flare stems, the bulb will have an increased effective luminescent length.

With regard to stems types, there is one which has the tipped-off portion of an exhaust pipe externally protruding from the end of the bulb, and another type which has no exhaust pipe at the end of the bulb. In the case where stems of the latter type are used, the tipped-off portion of the exhaust pipe does not protrude from the end of the bulb. Therefore, the end part of the bulb can be deeply inserted into the base body accordingly. Thus, a stem of this type is more effective in reducing the entire length of the lamp.

What is claimed is:

1. A low pressure gas discharge lamp comprising:

a bulb having electrodes provided in the end portions of the bulb; and a pair of bases attached to the ends of the bulb, each of said bases having a substantially cylindrical base body with a bottom wall, in which one end portion of the bulb is inserted, and a flat-plate receiving terminal secured to the base body and electrically connected to the electrode, said terminal having a pair of mutually parallel flat faces and being secured to the base body in such a manner that these flat faces are located on planes which exist perpendicular to a longitudinal axis of the bulb and a part of at least one flat face is in contact with the bottom wall of the base body, and said terminal projecting from the base body in a direction perpendicular to the longitudinal axis of the bulb.

2. A low pressure gas discharge lamp according to claim 1, wherein said receiving terminal is secured to the base body with part of their flat faces being in contact with an outer surface of the bottom wall.

3. A low pressure gas discharge lamp according to claim 2, wherein said base body has a connection groove formed on the outer surface of the bottom wall and open at a peripheral edge of the bottom wall, said receiving terminal being fitted into the connection groove.

4. A low pressure gas discharge lamp according to claim 3, wherein said connection groove has an upper groove portion open to the outer surface of the bottom wall and having a specified width, and a lower portion wider in width than the upper portion, said terminal having a width substantially equal to the width of the lower portion and being fitted in the lower portion.

5. A low pressure gas discharge lamp according to claim 4, wherein said terminal has a plurality of stopper teeth which engage the bottom wall so as to prevent the terminal from slipping out of the connection groove.

6. A low pressure gas discharge lamp according to claim 2, wherein said bulb includes a pair of lead wires each of which has one end connected to the corresponding electrode and the other end extending from the end of the bulb to the outside, each of said bases having a first through hole formed in the bottom wall and a second through hole formed in the terminal, the first and second through holes mutually extending in the axial direction of the bulb so as to be coaxial to one another, and located against the other end of the lead wire, the other end of the lead wire being inserted into first and second through holes and electrically connected to the terminal.

7. A low pressure gas discharge lamp according to claim 6, wherein said other end of each of the said lead wires is soldered to the corresponding terminal at the outside of the base body.

8. A low pressure gas discharge lamp according to claim 1, wherein said base body is glued to the end of the bulb, and has a working hole formed in the bottom wall for pouring adhesive into the gaps between the inner surface of the base body and the end of the bulb.

9. A low pressure gas discharge lamp according to claim 1, wherein said bulb has a light-emitting section which extends over most of the length of the bulb and along the axis of the bulb and has a specified width.

10. A low pressure gas discharge lamp according to claim 1, wherein each of said bases includes a second flat-plate receiving terminal which is electrically connected to the electrode and has a pair of mutually parallel flat faces, said second terminal being secured to the base body such that it is located in the plane on which said terminal is located and part of at least one face of the second terminal contacts the bottom wall, and protruding from the base body in a direction perpendicular to the axis of the bulb.

11. A low pressure gas discharge lamp comprising:

a bulb having electrodes provided in the end portions of the bulb;

a pair of bases attached to the ends of the bulb; and a pair of terminals secured to the bases and electrically connected to the electrodes, respectively, each of said terminals comprising a pair of coplanar flat plates being secured to the base so as to be located on a common plane perpendicular to a longitudinal axis of the bulb, and projecting from the base in said direction perpendicular to the longitudinal axis of the bulb.

12. A low pressure gas discharge lamp according to claim 11, wherein each of said bases includes a substantially cylindrical base body with a bottom wall, into which one end portion of the bulb is inserted, and said flat plates are secured to the bottom wall.

13. A low pressure gas discharge lamp according to claim 12, wherein each of said bases includes a pair of connection grooves formed on an outer surface of the bottom wall, and said flat plates are fitted into the connection grooves, respectively.

14. A low pressure gas discharge lamp according to claim 13, wherein each of said bases includes a pair of first through holes formed in the bottom wall and extending in the axial direction of the bulb, each of said flat plates has a second through hole coaxially extending with the corresponding first through hole, said bulb includes two pairs of lead wires each pair of which is connected to the electrode, each of said lead wires having one end extending from the end of the bulb to the outside and inserted into the first and second through holes, and said one end being electrically connected to the flat plate.

* * * * *